US006511121B1

(12) United States Patent
Cochran et al.

(10) Patent No.: US 6,511,121 B1
(45) Date of Patent: Jan. 28, 2003

(54) REINFORCING GROMMET AND SUPPORTING BRACE COMBINATION FOR USE WITH COLLAPSIBLE FURNITURE

(75) Inventors: Marian Harding Cochran, Hollywood, FL (US); Nelson Liao, Taipei (TW)

(73) Assignee: Atico International USA, Inc., Ft. Lauderdale, FL (US)

( * ) Notice: Subject to any disclaimer, the term of this patent is extended or adjusted under 35 U.S.C. 154(b) by 0 days.

(21) Appl. No.: 09/977,113

(22) Filed: Oct. 12, 2001

(51) Int. Cl.[7] ..... A47C 4/28

(52) U.S. Cl. ..... 297/16.1; 297/463.1; 297/463.2; 297/45

(58) Field of Search ..... 297/45, 16.1, 463.1, 297/463.2

(56) References Cited

U.S. PATENT DOCUMENTS 5,975,626 A 11/1999 Aycock
6,082,813 A * 7/2000 Chen ..... 297/16.1
D432,325 S 10/2000 Zheng et al.
D432,823 S 10/2000 Zheng
6,158,361 A 12/2000 Zheng et al.
6,179,374 B1 * 1/2001 Tang ..... 297/42
6,231,119 B1 5/2001 Zheng
6,234,089 B1 5/2001 Zheng et al.
6,241,311 B1 * 6/2001 Zheng ..... 297/16.1
6,247,749 B1 * 6/2001 Yu ..... 297/16.2
6,302,479 B1 10/2001 Zheng

* cited by examiner

*Primary Examiner*—Peter M. Cuomo
*Assistant Examiner*—Erika Garrett
(74) *Attorney, Agent, or Firm*—Gibbons, Del Deo, Dolan, Griffinger & Vecchione

(57) ABSTRACT

A combination of a reinforcing grommet in a D-shape or a closed horseshoe shape and a supporting brace for holding a tensioned surface on an inclined frame element of a frame of a collapsible furniture item, such as a chair, a stool, lounger, table, a cot or a bed. A contact portion of a lower surface of the grommet rests on a brace and a remaining portion of the lower surface spans a recess in the brace. The brace is freely movable to and fro relative to the frame tube so as to minimize tearing forces.

6 Claims, 4 Drawing Sheets

REINFORCING GROMMET AND SUPPORTING BRACE COMBINATION FOR USE WITH COLLAPSIBLE FURNITURE

BACKGROUND OF THE INVENTION

1. Field of the Invention

The present invention relates to a combination of a grommet and brace for use with collapsible furniture, and more particularly pertains to a combination of a reinforcing grommet for attaching a tensioned fabric surface on an inclined collapsible frame tube and a supporting brace for maintaining the grommet when a weight is placed on the surface, where the grommet in combination with the brace prevents tearing of the tensioned surface at the site of attachment to the frame.

2. Discussion of the Related Art

This application incorporates by reference the disclosure, including the figures, of U.S. Pat. No. 6,241,311 B1, entitled "SUPPORT RING FOR HOLDING A FABRIC SEAT ON INCLINED FRAME TUBE."

In accordance with that disclosure, when a frame element is inserted through the grommet and brace openings, the frame element rests against the grommet at two spaced apart locations. The present inventors found that by positioning the brace relative to the grommet in a particular manner and angling the recess of the brace accordingly, the frame element is held in the recess and only rests against the grommet at one location as opposed to two spaced apart locations.

Further the shape of the grommet, placement hole and brace openings that are in alignment need not at all be elliptical. The inventors found that a D-shape or horseshoe shaped is suitable.

BRIEF SUMMARY OF THE INVENTION

One aspect of the invention resides in a reinforcing grommet and supporting brace recombination for use in connection with a collapsible furniture item. The combination includes a grommet having a top surface and a bottom surface and includes a brace with a recess. The bottom surface of the grommet having a contact portion resting on the brace and having a remainder spanning the recess the grommet having a frame element placement hole that is of a dimension sufficient to allow a frame element to pass freely therethrough. The brace is configured to retain the frame element at a relative position to the grommet.

DETAILED DESCRIPTION OF THE INVENTION

Figure 1:
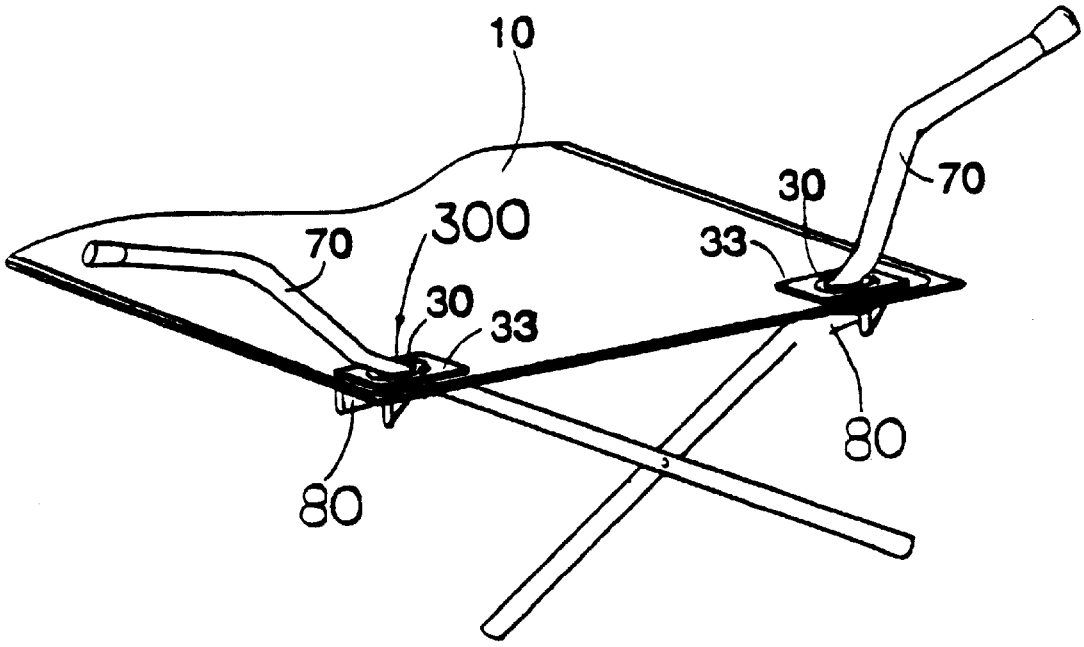
FIG. 1 is a perspective view of the invention used in connection with a collapsible chair.
Figure 2:
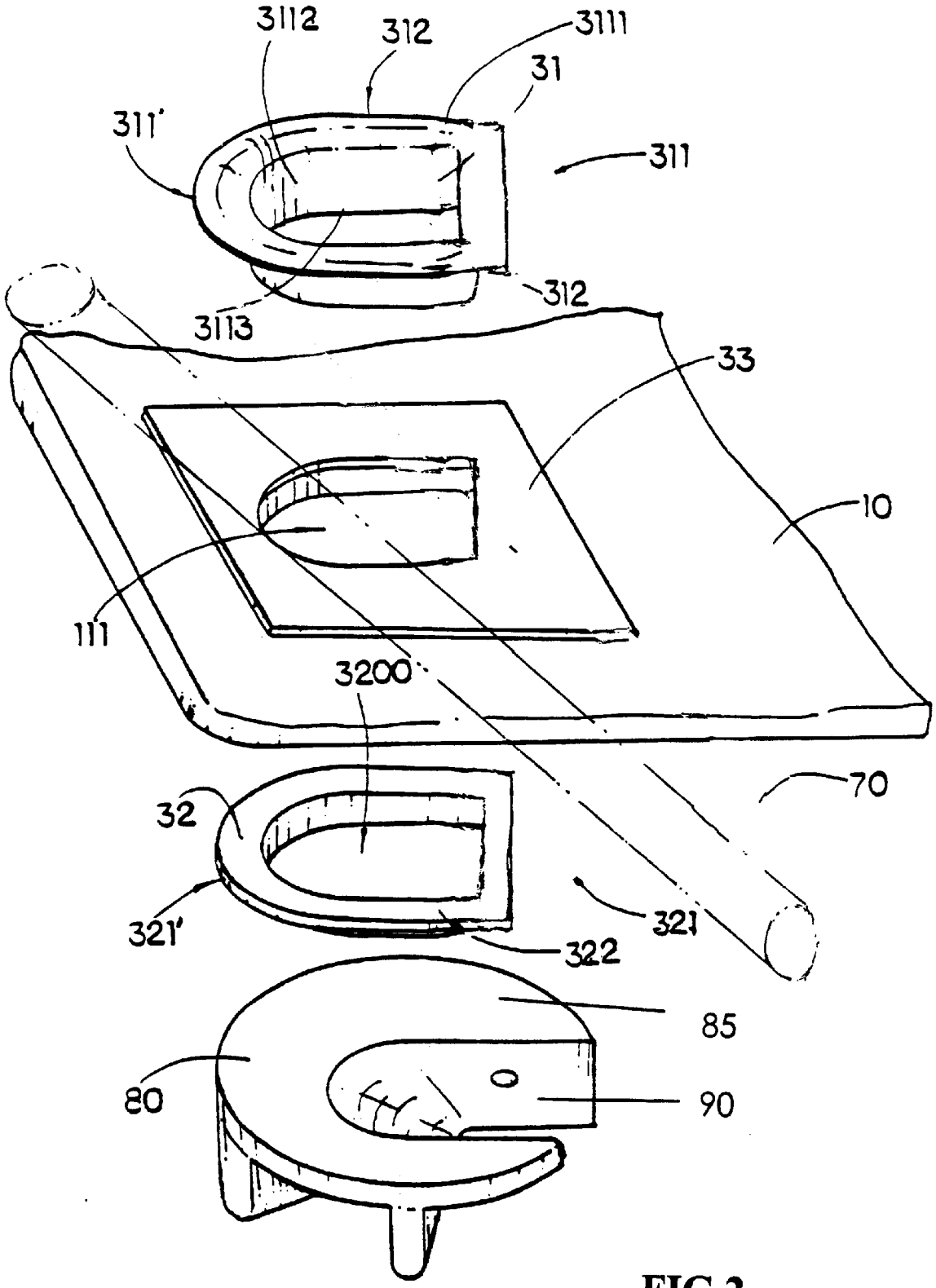
FIG. 2 is an exploded view of the invention.
Figure 3:
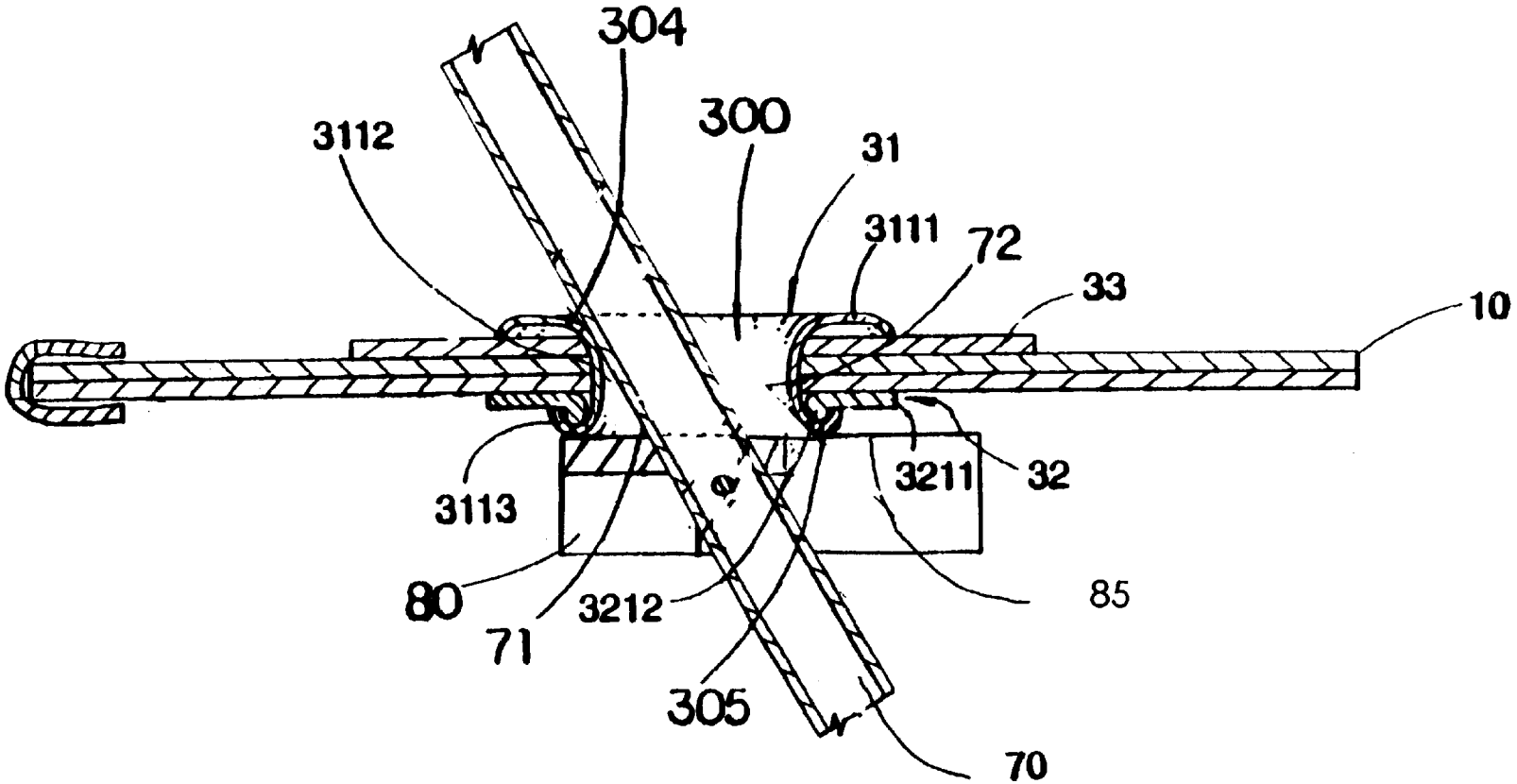
FIG. 3 is a cross-section of FIG. 2, but in a fully assembled condition.
Figure 4:
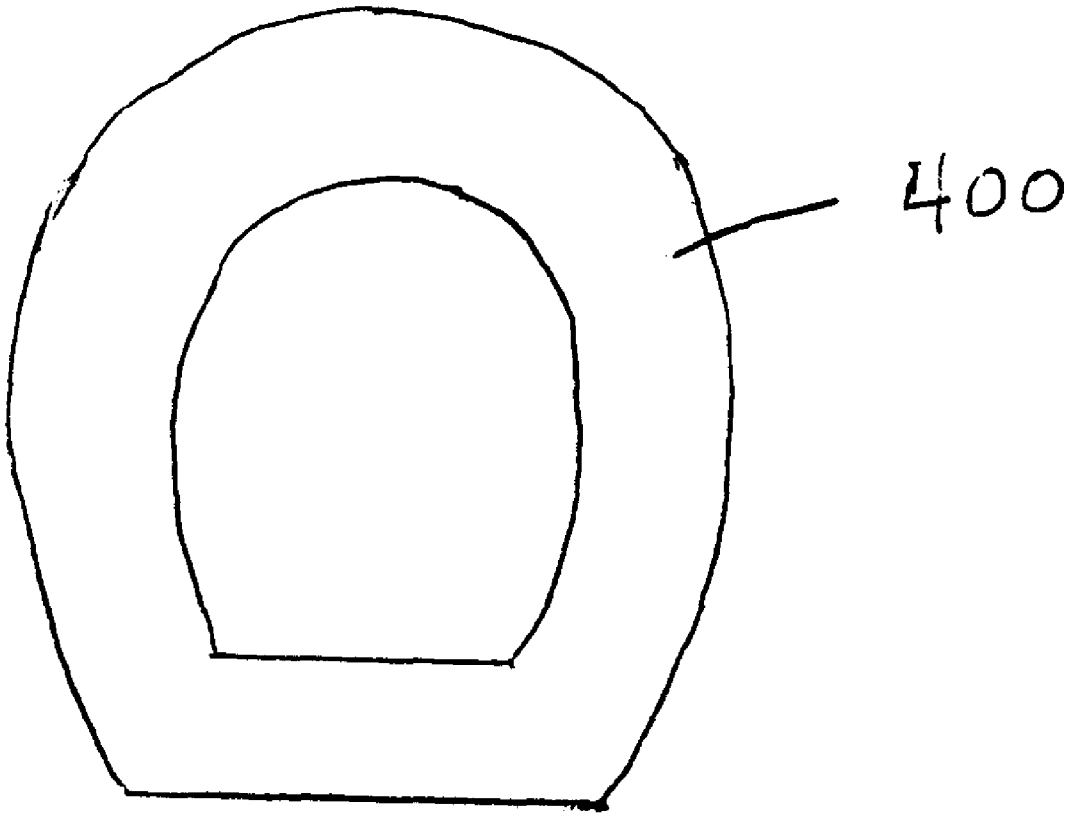
FIG. 4 is a top view of further embodiment of the invention.

Referring to FIGS. 1–3, the same reference numerals are used as are found in FIGS. 2, 3 and 4 respectively of U.S. Pat. No. 6,241,311 B1 to identify counterparts in the present application. The present invention provides a combination of a reinforcing grommet 30 and a supporting brace 80 for use in connection with a portable, collapsible furniture item. The furniture item includes a tensioned surface 10 having frame element placement holes 111 formed at the corners. Inclined frame elements 70 penetrate through the holes 111 respectively for supporting the tensioned surface 10 in position. The reinforcing grommet 30 reinforces the structural integrity of the frame element placement hole 111 and adds stiffness and durability thereto while allowing the tensioned surface to shift more freely when weight is applied to the chair seat. The supporting brace 80 includes a resting surface 85 and a recess 90, and provides support for the reinforcing grommet 30 (and thereby, the frame element placement hole 111) when forces are applied to the surface 10 as the result of a weight being placed thereon. The brace 80 also serves to dissipate and evenly distribute the effects of the applied forces away from the grommet and the frame element placement hole.

The collapsible furniture item may be a chair, lounger, table, a stool, a cot or a bed.

As shown in FIGS. 1 and 3, the grommet 30 and support brace 80 are configured and arranged in combination such that, when weight-related forces are applied to the surface 10, a contact portion of a lower surface of a lower grommet member 32 rests entirely on the resting surface 85 of the brace 80, with a remaining portion of the lower surface spanning the recess 90. In this combination, the frame element 70 is free and clear of the lower surface of the lower grommet member 32 as it passes through a reinforcing hole corresponding to the frame element placement hole 111. The recess 90 of the brace 80 is configured to retain the frame element 70 in a relative position that is spaced from and clear of the lower surface of the grommet.

Referring to FIG. 2, the structure comprising the grommet 30 is described and disclosed in U.S. Pat. No. 6,241,311 B1 at col. 3, 1. 43–col. 4, 1. 2, but the configuration is different in that the grommet defines a closed-horseshoe or "D" shape in the present invention in contrast to a elliptical shape of U.S. Pat. No. 6,241,311 B1. As well, a method of mounting the grommet 30 around the frame element placement hole 111 is described and disclosed in U.S. Pat. No. 241,311 B1 at col. 4, 11. 3–23, which is equally applicable here.

As shown in FIGS. 2 and 3, the support brace 80 is securably attached to the frame element 70. When the frame element 70 is passed through the reinforcing grommet 30 as the tensioned surface 10 is connected to the frame, the grommet 30 and brace 80 are positioned one above the other.

Further as shown in FIGS. 2–3, the surface 85 of the brace 80 is configured and arranged to be able to support the entirety of the contact portion of the lower surface of the lower grommet member 32 thereon, both when the weight-related forces are applied to the tensioned surface 10 and also when no such forces are extant but the furniture item is in its open, or in a "use," position. In both states, the remaining portion of the lower surface spans the recess 90. As stated, in such configuration, the frame element 70 is free and clear of the lower surface of the lower member 32 of the grommet 30. Accordingly, stresses as the result of the forces resulting from a weight being placed on the surface 10 are dissipated and distributed entirely by the brace 80, and more particularly at the resting surface 85 thereof. The reinforcing grommet 36 and frame element placement hole 111 are free of such stresses or forces.

Moreover, in the grommet-and-brace combination of the present invention, when a weight-related force is applied to tensioned surface 10, the reinforcing grommet 30, the contact portion of the lower surface of which is fully supported on the resting surface 85 of the brace 80 and the remaining portion of the lower surface of which spans the recess 90, retains a freedom of movement to-and-fro against the frame element 70. This freedom of movement in the "open" position allows the reinforcing grommet 30 to move relative to the frame element 70, thereby further minimizing the tearing force applied to the frame element placement hole 111 as a result roof weight-related forces applied to the tensioned surface 10.

In view of above, the reinforcing grommet 30 and support brace 80 combination of the present invention can substantially achieve the following features:

1. The reinforcing grommet 30 is adapted to reinforce the structural integrity of the frame element placement hole 111 of the tensioned surface 10 when the surface 10 is attached to the furniture item frame and forces are applied to the surface 10 by a weight being placed thereon.

2. Moreover, the grommet 30, when used in combination with the brace 80, such that the lower surface of the lower member 32 of the grommet 30 rests entirely on the resting surface 85 of the brace 80, retains a freedom of movement such that any tearing forces acting to tear or otherwise rupture or deform the frame element placement hole 111 are minimized.

3. The combination of the grommet 30 and the brace 80 thus can limit damage to the area around the frame element placement hole 111 of the tensioned surface 10 as the collapsible furniture item is used.

FIG. 4 shows a further embodiment in which the shape of the grommet 400 resembles that of a closed horseshoe shape as opposed to a D-shape of FIGS. 1–3. The grommet 400 is of the same depth as is the grommet 30 and is likewise made of two halves fit together. The grommet 400 is simply substituted for the grommet 30 and the fabric opening conforms to the outline shape of the grommet 40.

While the invention has been described with respect to certain specific embodiments, it will be appreciated that many modifications and changes may be made by those skilled in the art without departing from the invention. It is intended, therefore, by the appended claims to cover all such modifications and changes as may fall within the true spirit and scope of the invention.

What is claimed is:

1. A combination of a reinforcing grommet, a supporting brace and a frame element for use in connection with a collapsible furniture item, comprising a reinforcing grommet, a supporting brace having a recess, said grommet having a contact portion resting on said brace and having a further portion spanning across said recess, said grommet defining an aperture that is in the shape of one of a D-shape and a closed horseshoe shape, and a frame element that extends through said aperture and is retained in said recess and rests on said brace within said recess, said one of said D-shape and said closed horseshoe shape being of a dimension sufficient to allow said frame element to pass freely therethrough and having a straight edge side and a curved edge side opposite the straight edge side, said recess of said brace being configured and arranged to retain said frame element at a relative position that is both in contact with said curved edge side of said grommet at said frame element placement hole and is spaced from and entirely clear of said straight edge side of grommet at said frame element placement hole as said contact portion of said grommet rests on said brace.

2. The combination of claim 1, further comprising a tensioned surface having at least one opening that is reinforced by said grommet and is in alignment with said frame element placement hole.

3. The combination of claim 1, wherein said furniture item is selected from a group consisting of a chair, table, a stool, lounger, a cot, and a bed.

4. A combination of a reinforcing grommet, a supporting brace, and a collapsible furniture item that includes a tensioned surface and a frame, said brace having a recess, said grommet and brace being configured and arranged in combination with each other such that when forces arc applied to said furniture item as a result of a weight being placed on said tensioned surface a contact portion of said grommet rests entirely on a resting surface of said brace and a further portion spans across said recess, said grommet having a frame element placement hole that is in the shape of one of a closed horseshoe shape and a D-shape so as to have a straight edge side and a curved edge side opposite the straight edge side, and a frame element of said frame passing through the frame element placement hole reinforced by said grommet and being entirely clear of said straight edge side of said grommet, and said grommet and said aperture being free of tearing effects of said forces, said brace being configured and arranged to retain said frame element at a relative position that is both in contact with said curved edge side of said grommet at said frame element placement hole and spaced from and entirely clear of said straight edge side of said grommet.

5. The combination of claim 1, wherein said brace is securably attached to at least one of said frame elements at a location on said frame element such that when said frame element is passed through said frame element placement hole to rest on the ground said grommet is above said supporting brace relative to the ground.

6. The combination of claim 1, wherein said furniture item is selected from a group consisting of a chair, a stool, a cot, lounger, table and a bed.

* * * * *

UNITED STATES PATENT AND TRADEMARK OFFICE

CERTIFICATE OF CORRECTION

PATENT NO. : 6,511,121 B1
DATED : January 28, 2003
INVENTOR(S) : Marian Harding Cochran et al.

It is certified that error appears in the above-identified patent and that said Letters Patent is hereby corrected as shown below:

Column 2,
Line 41, change "241,311B1" to -- 6,241,311 B1 --;

Column 3,
Line 8, change "roof" to -- of --.

Signed and Sealed this

Tenth Day of June, 2003

JAMES E. ROGAN
*Director of the United States Patent and Trademark Office*